US006588617B1

(12) United States Patent
Majcen et al.

(10) Patent No.: US 6,588,617 B1
(45) Date of Patent: Jul. 8, 2003

(54) ROTATIVE CLOSURE FOR BEVERAGE CONTAINERS

(76) Inventors: Marjan Majcen, 22 S. Ridgewood Rd., South Orange, NJ (US) 07079; Beverly Burke, 22 S. Ridgewood Rd., South Orange, NJ (US) 07079

( * ) Notice: Subject to any disclaimer, the term of this patent is extended or adjusted under 35 U.S.C. 154(b) by 0 days.

(21) Appl. No.: 10/053,684

(22) Filed: Jan. 21, 2002

(51) Int. Cl.[7] ..... B65D 51/18

(52) U.S. Cl. ..... 220/254.4; 220/258.2; 220/906

(58) Field of Search ..... 220/254.1, 254.4, 220/258.1, 258.2, 258.3, 253, 821, 906

(56) References Cited

U.S. PATENT DOCUMENTS 4,717,039 A * 1/1988 Ayyoubi ..... 220/253
4,852,763 A * 8/1989 Dimberio ..... 220/253
4,880,136 A * 11/1989 Englert ..... 220/253
5,421,472 A * 6/1995 Beckertgis ..... 220/253

FOREIGN PATENT DOCUMENTS

WO 98/49066 * 11/1998

* cited by examiner

*Primary Examiner*—Nathan J. Newhouse
(74) *Attorney, Agent, or Firm*—Michael I Kroll

(57) ABSTRACT

A rotative closure for beverage containers wherein a rotatable sealing plate sits atop the fixed top plate of a conventional beverage canister having a recess that corresponds with the recess of the fixed top plate in such a manner that when both recesses are aligned the user may pour out the contents contained therein. Rotating the sealing plate until the corresponding recesses are completely misaligned prevents the contents from escaping despite the orientation of the container. Furthermore, entry into the container is also refused.

2 Claims, 14 Drawing Sheets

ROTATIVE CLOSURE FOR BEVERAGE CONTAINERS

BACKGROUND OF THE INVENTION

1. Field of the Invention

The present invention relates generally to containers and, more specifically, to beverage containers. The present invention is a rotatable plate that is used for resealing the opening of the container created by the lifting of a tab and piercing the preformed seal of the plate. The rotatable plate is comprised of a planar element affixed to the beverage container by means of a fastener that also secures the penetrating tab. The rotatable plate has an aperture conforming substantially to the size and shape of the beverage container aperture that is formed after lifting the tab and breaking the preformed seal of the beverage container. The rotatable plate has a protrusion that extends upward away from the contents of the container. The fastener that secures the rotating plate and penetrating tab act as the pivot point when radial force is applied to the protrusion on the rotating plate.

Rotation of the rotatable plate until the rotating plate aperture aligns with the beverage container aperture provides access to the contents of the beverage container. Rotation of the rotatable plate. until the rotating plate aperture is completely misaligned with the beverage container aperture provides resealing of the beverage container.

2. Description of the Prior Art

There are other container devices designed as beverage containers. While these beverage containers may be suitable for the purposes for which they where designed, they would not be as suitable for the purposes of the present invention as heretofore described. It is thus desirable to provide an improved method to preserve opened beverage container contents.

It is further desirable to protect the exposed beverage. container contents from outside contaminations using the rotative plate of the present invention. The prior art container has a tab that is fastened to the top plate of the container that is used primarily to pierce the preformed seal providing access to the contents of the container with no means to reseal the top plate opening.

SUMMARY OF THE PRESENT INVENTION

A primary object of the present invention is to provide means to reseal an opened beverage container.

Another object of the present invention is the preservation of the contents of an opened beverage container.

Yet another object of the present invention is to provide means in which to protect against accidental spilling of the contents of an open container.

Still yet another object of the present invention is to provide protection against the introduction of outside contaminations.

Another object of the present invention is to provide interchange ability between sealing and accessing the contents of the previously opened beverage container.

Yet another object of the present invention is to provide self-contained means to reseal the contents of the previously opened beverage container.

Still yet another object of the present invention is to provide protection against insects of the previously opened beverage container.

Additional objects of the present invention will appear as the description proceeds.

The present invention overcomes the shortcomings of the prior art by providing a means to selectively reseal the opening of a previously opened beverage container.

The foregoing and other objects and advantages will appear from the description to follow. In the description reference is made to the accompanying drawing, which forms a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawing, like reference characters designate the same or similar parts throughout the several views.

The following detailed description is, therefore, not to be taken in a limiting sense, and the scope of the present invention is best defined by the appended claims.

BRIEF DESCRIPTION OF THE DRAWING FIGURES

In order that the invention may be more fully understood, it will now be described, by way of example, with reference to the accompanying drawing in which.

DESCRIPTION OF THE REFERENCED NUMERALS

Figure 1:
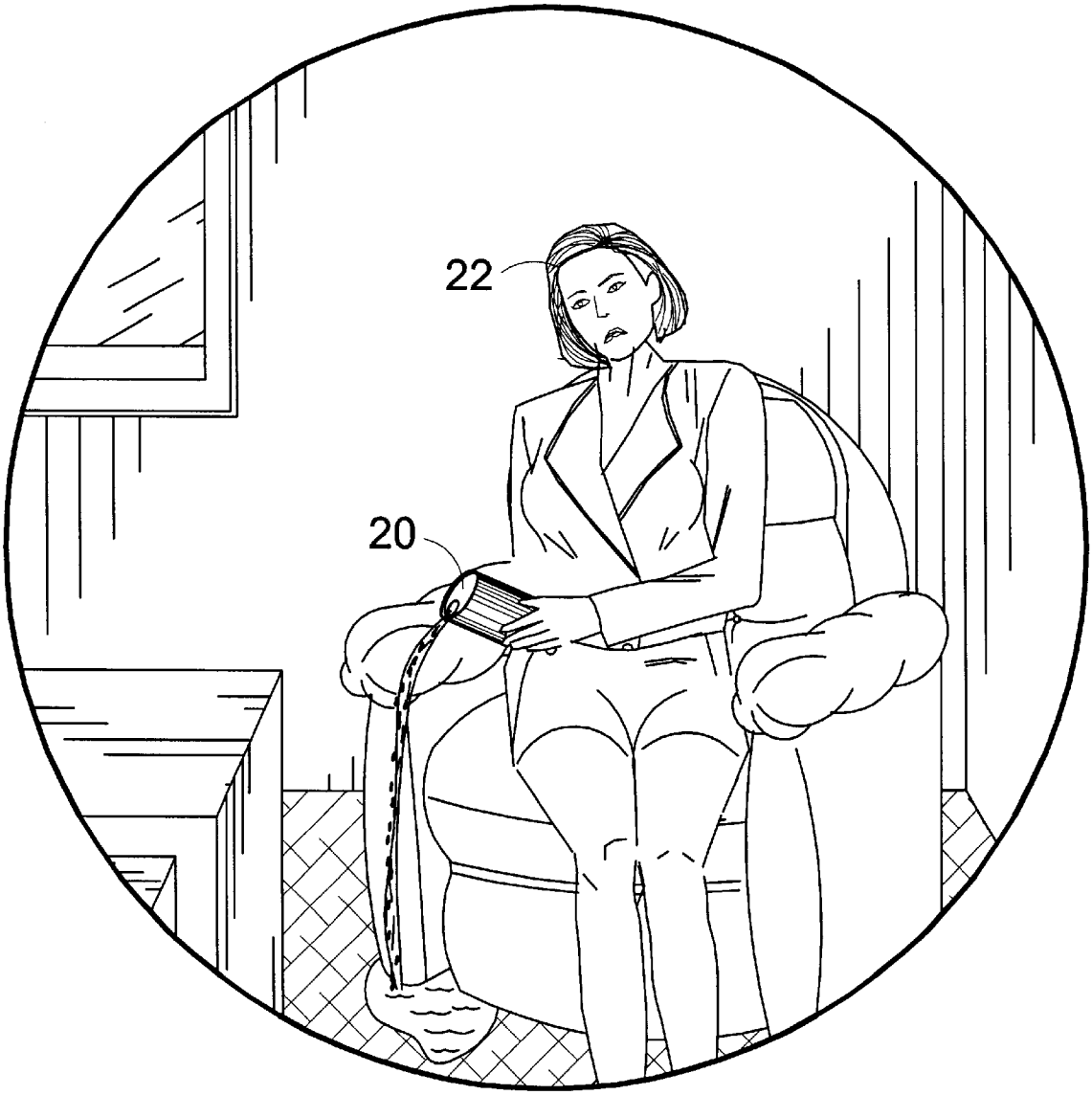
FIG. 1 is an illustrative view of the prior art in use.

Turning now descriptively to the drawings, in which similar reference chracters denote similar elements throughout the several views, the FIGS. illustrate the high volume disposable aspirator of the present invention. With regard to the reference numerals used, the following numbering is used throughout the various drawing figures.

10 rotative closure for beverage containers
12 base container
14 fixed top plate of container

16 penetrating tab
18 etched section of 14
20 conventional beverage container
22 user
24 sealing plate
26 recess of 24
28 access recess of 14
30 access tab
32 finger handle
34 pivoting fastening element
36 channel of 14
38 lever mechanism
40 first end of 38
42 second end of 38
44 flange of 12

DETAILED DESCRIPTION OF THE PREFERRED EMBODIMENT

The following discussion describes in detail one embodiment of the invention. This discussion should not be construed, however, as limiting the invention to those particular embodiments, practitioners skilled in the art will recognize numerous other embodiments as well. For definition of the complete scope of the invention, the reader is directed to appended claims.

FIG. 1 is an illustrated view showing the user 22 spilling a conventional beverage container 20 that is prone to spills once the beverage container 20 is opened. The conventional beverage container 20 is also exposed to outside elements and contamination.

Figure 2:
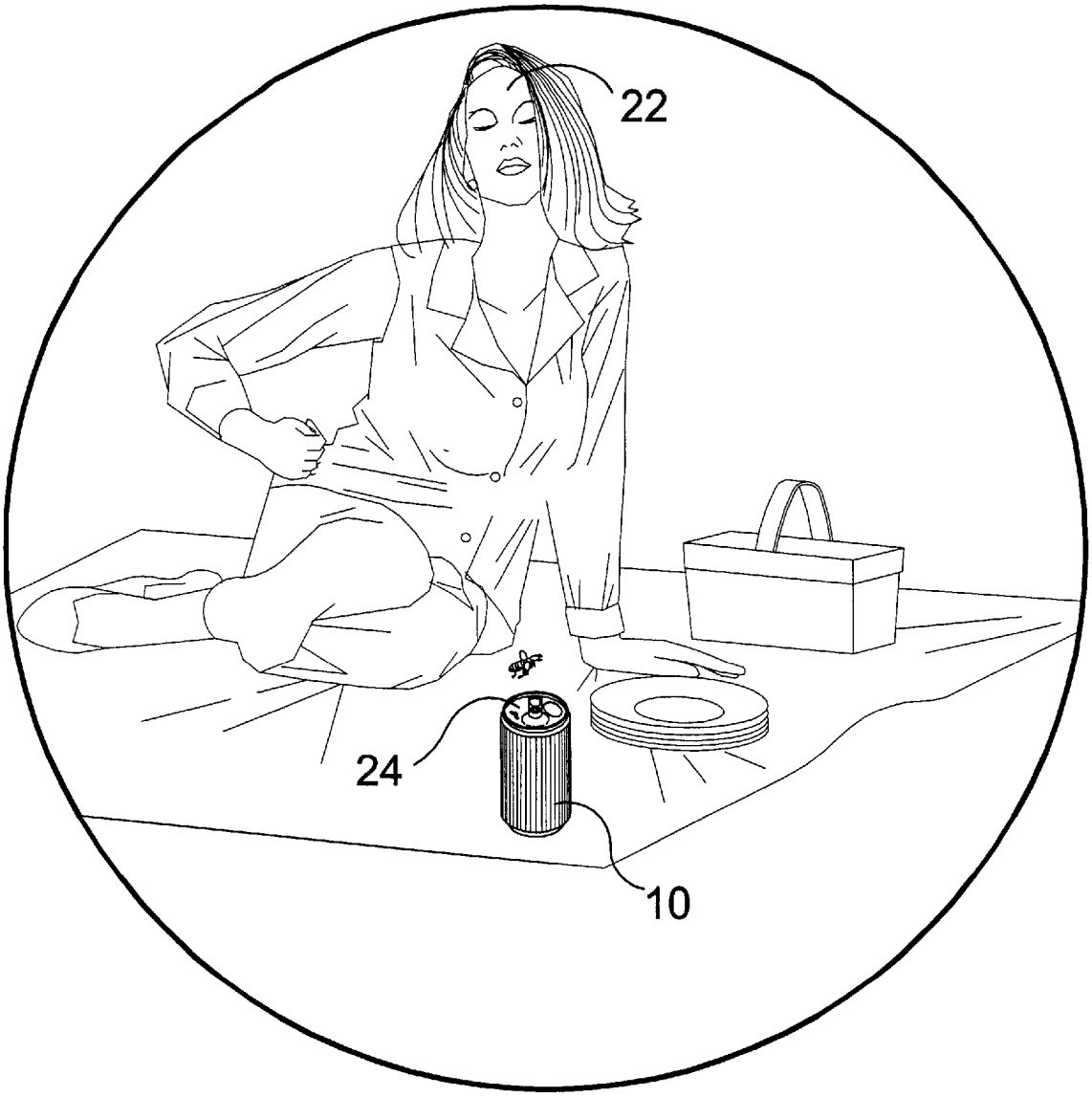
FIG. 2 is an illustrative view of the present invention in use.

FIG. 2 is an illustrated view of the present invention 10 utilizing a rotatable self-contained sealing plate 24 to protect against exposure and outside contamination. The rotatable sealing plate 24 is turned to the closed position and the contents are shielded from outside contaminates and thus preserved. Access to the contents is gained by rotating the sealing plate 24 until the sealing plate recess 26 is aligned with the recess of fixed top plate 14. The rotation from closed position to open position can be performed as many times as necessary.

Figure 3:
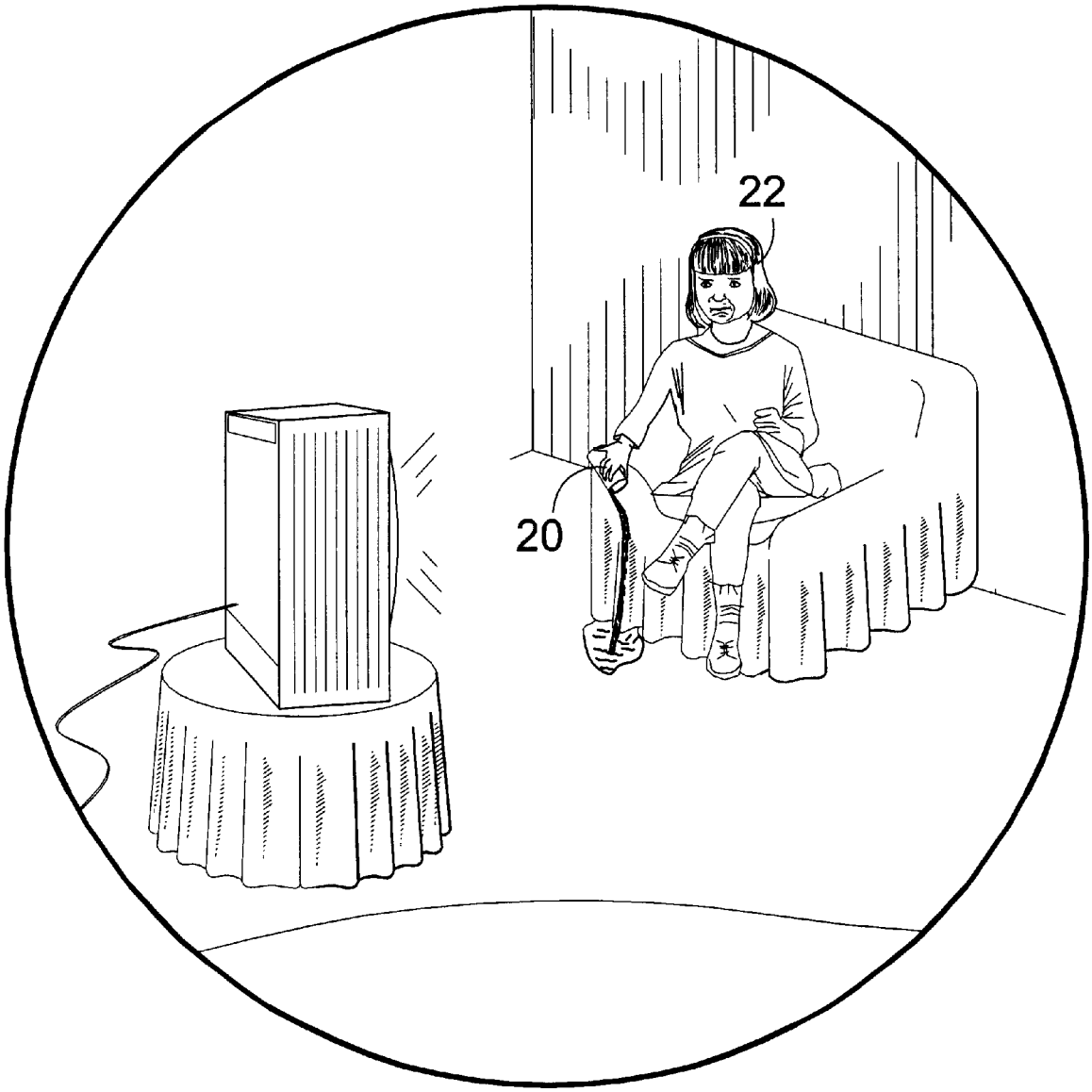
FIG. 3 is an illustrative view of the prior art in use.

FIG. 3 is an illustrative view of the prior art in use showing the user 22 spilling the contents of a conventional beverage container 20.

Figure 4:
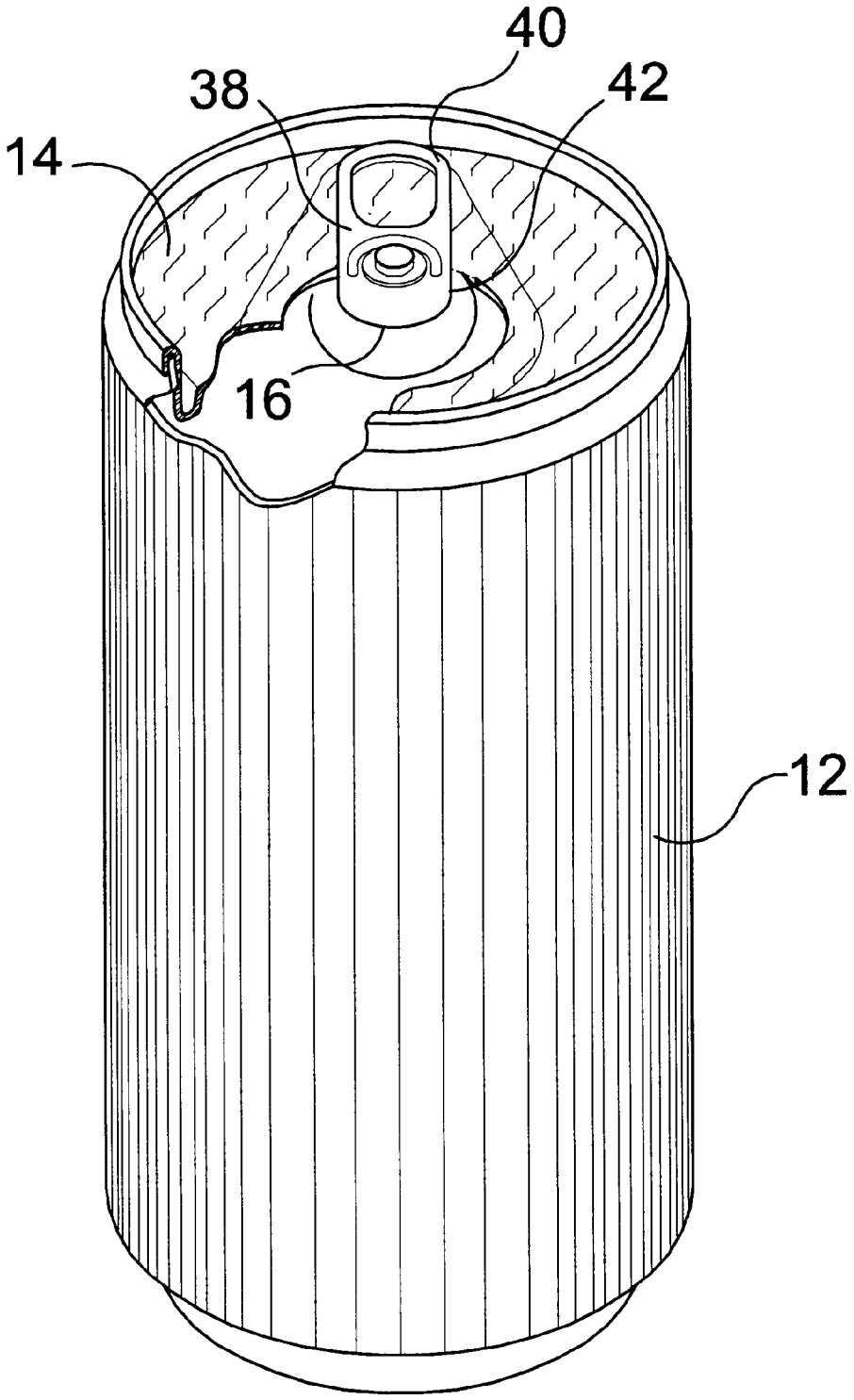
FIG. 4 is an illustrative view of the prior art in an open position.

FIG. 4 is a perspective view of the prior art. When the penetrating tab 16 is lifted it pierces the etched section 18 of the fixed top plate 14 and provides access to the contents of the base container 12. Once the access tab 30 is opened there is nothing to prevent spillage or contaminates from entering the base container 12.

Figure 5:
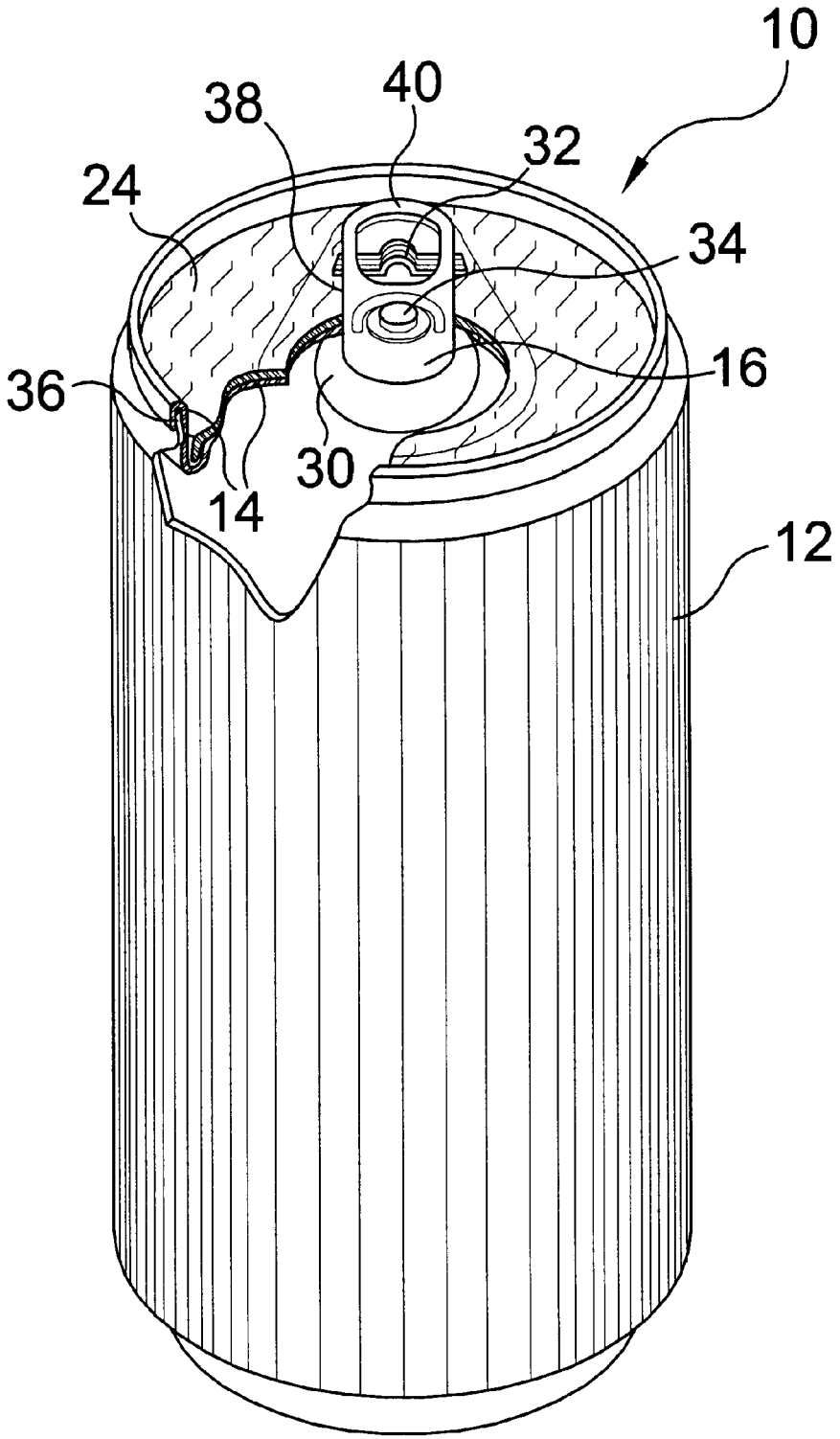
FIG. 5 is an illustrative view of the present invention in an open position.

FIG. 5 is a perspective view of the present invention 10 in the open position. To gain access to the contents of the base container 12, the user aligns the sealing plate recess 26 over access plate recess 28. The extruded finger handle 32 is used to rotate the sealing plate 24 into position. Lift the penetrating tab 16 to separate the access tab 30 from the fixed top plate 14.

Figure 6:
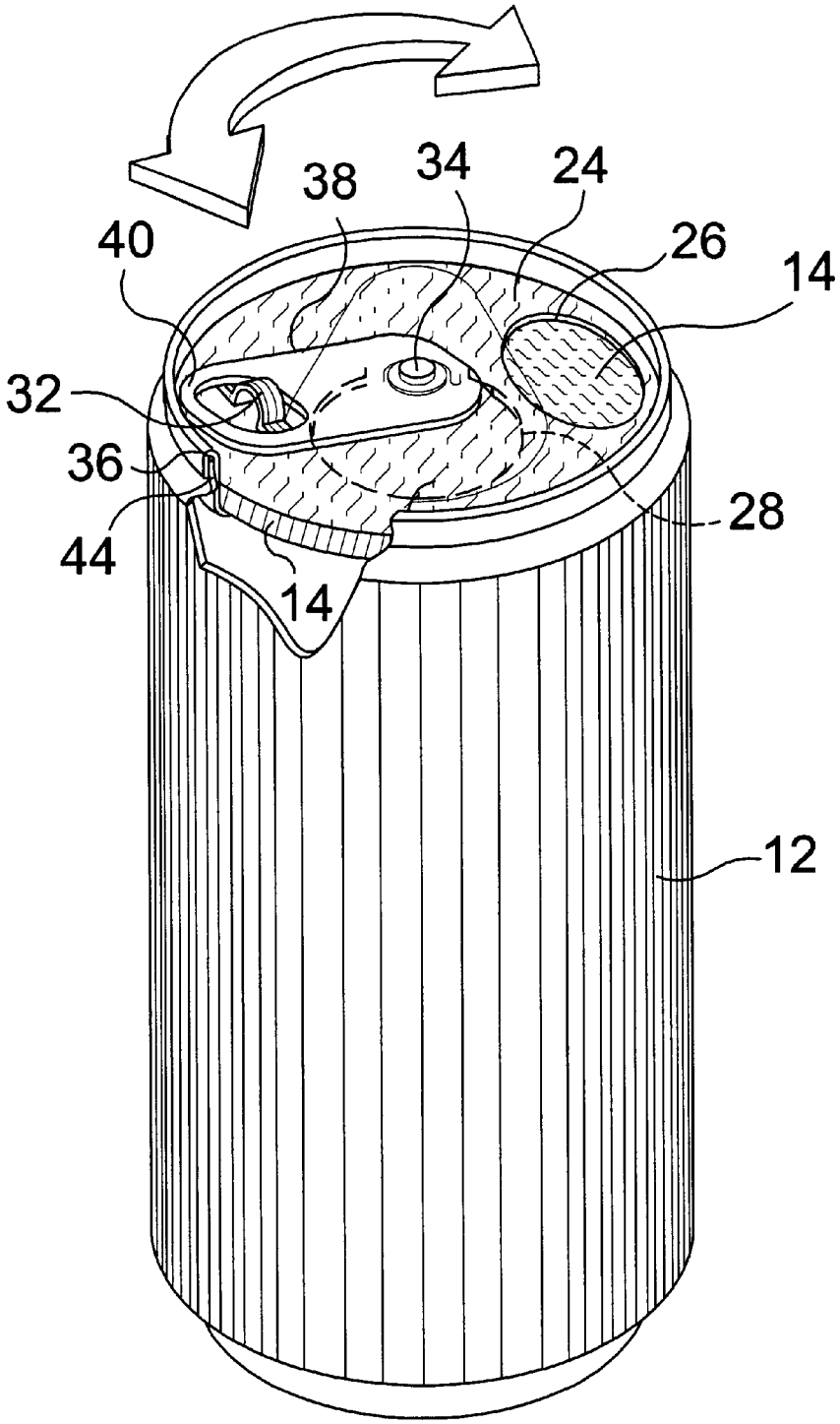
FIG. 6 is an illustrative view of the present invention in a resealed position.

FIG. 6 is a perspective view of the present invention 10 in the closed position. If the access tab 30 of the fixed top plate 14 is broken, the contents of the base container 12 can be preserved and protected from outside contaminates. To move the present invention 10 into the closed position, rotate the sealing plate 24 around the pivoting fastening element 34 using the extruded finger handle 32 until there is no portion of the sealing plate recess 26 aligned with the fixed top plate recess 28. The sealing plate 24 can be rotated in either direction. To regain access to the base container contents, rotate the sealing plate 24 so that the sealing plate recess 26 is again aligned with the access plate recess 28.

Figure 7:
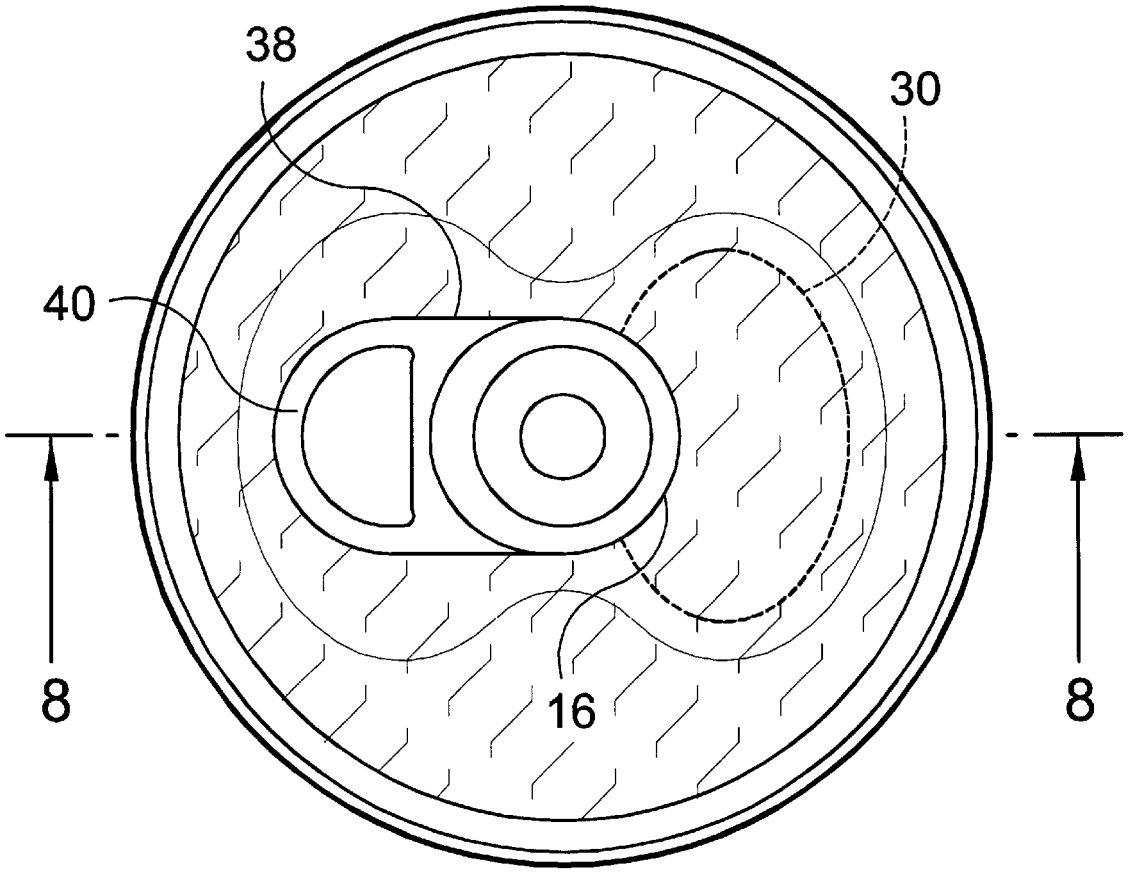
FIG. 7 (PRIOR ART)
FIG. 7 is a top view of the existing art in the closed position.

FIG. 7 is a top view of the prior art in the closed position. The fixed top plate 14 is sealed around the outer rim of the base container 12. When the penetrating tab 16 is lifted it pierces the access tab 30 thereby separating it from the fixed top plate 14.

Figure 8:
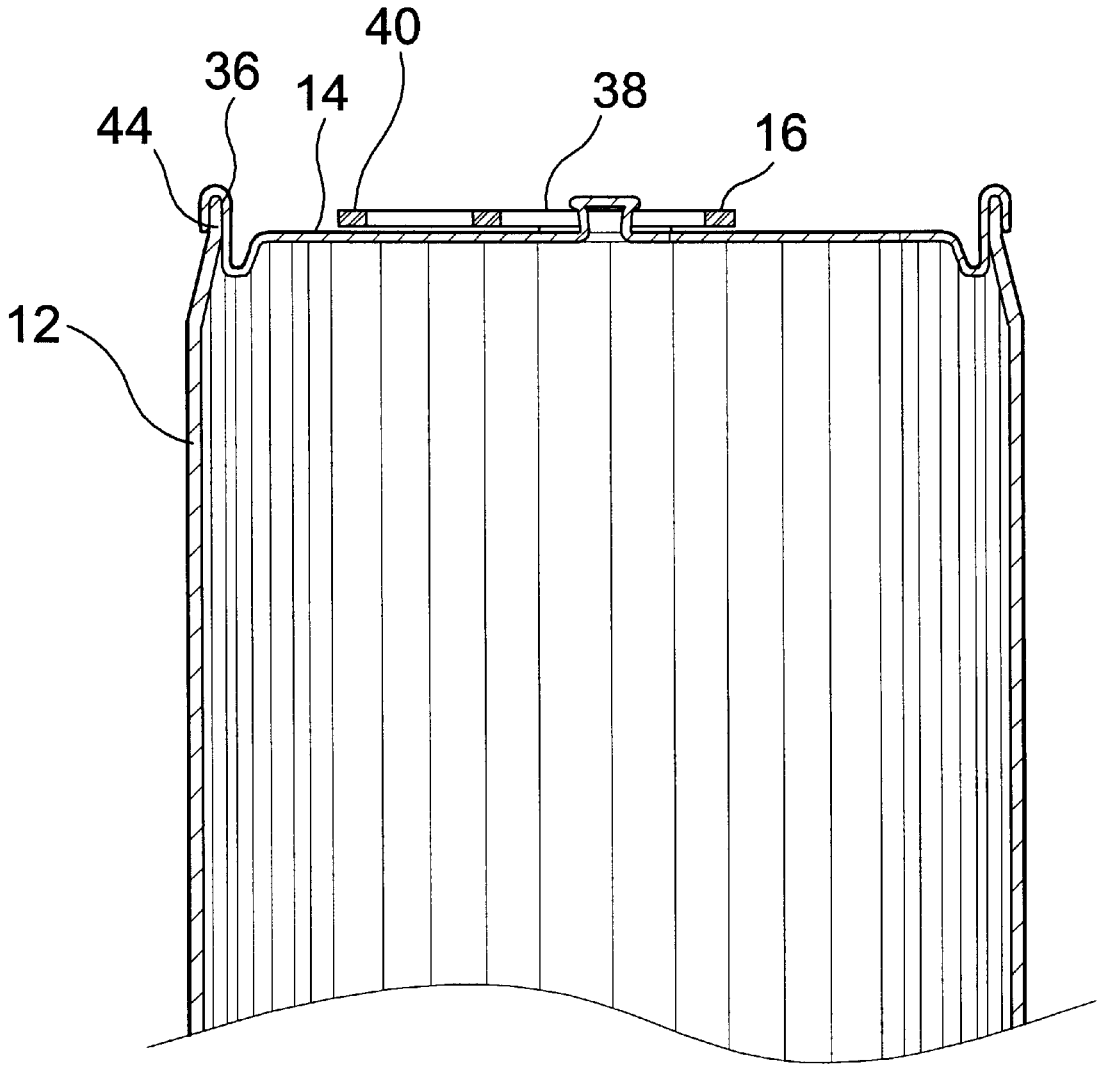
FIG. 8 (PRIOR ART)
FIG. 8 is a cross sectional view in reference to FIG. 6 of the existing art.

FIG. 8 is a cross sectional side view of the prior art. The conventional beverage container 20 provides an interlocking seal between the base container 12 and the fixed top 14. The etched access tab 30 is in the sealed position.

Figure 9:
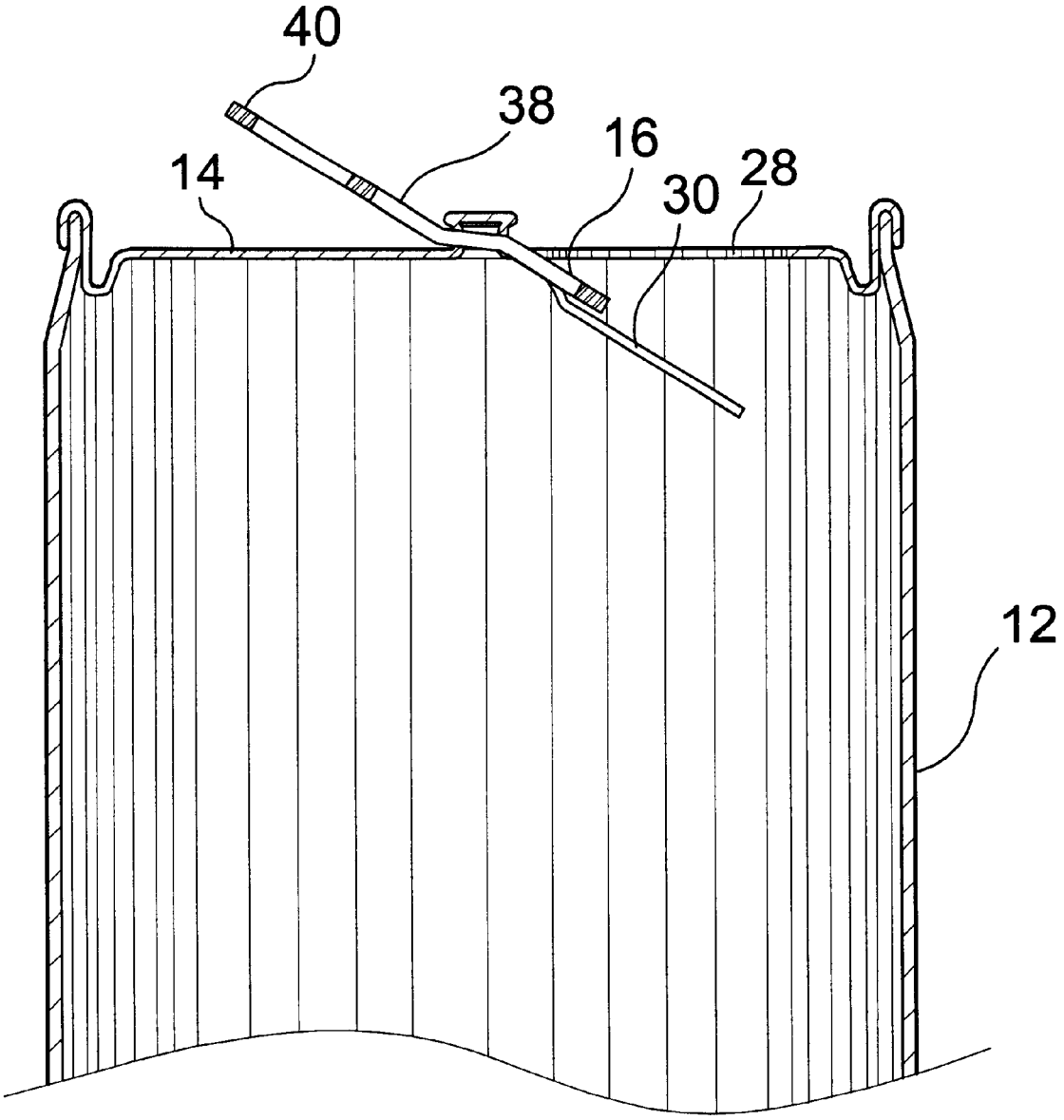
FIG. 9 (PRIOR ART)
FIG. 9 is a cross sectional view in reference to FIG. 7 of the existing art in the open position.

FIG. 9 is a cross sectional side view of the prior art in the open position. The conventional beverage container 20 allows access to the contents of the base container 12 by lifting upward on the penetrating tab 16 thereby separating most of the access tab 30 from the fixed top plate 14 and creating an access recess 28 to the contents therein. Once the penetrating tab 16 has been lifted and the access recess 28 in the fixed top plate 14 has been separated therefrom, there is no means to preserve or prevent contaminates from entering the base container 12.

Figure 10:
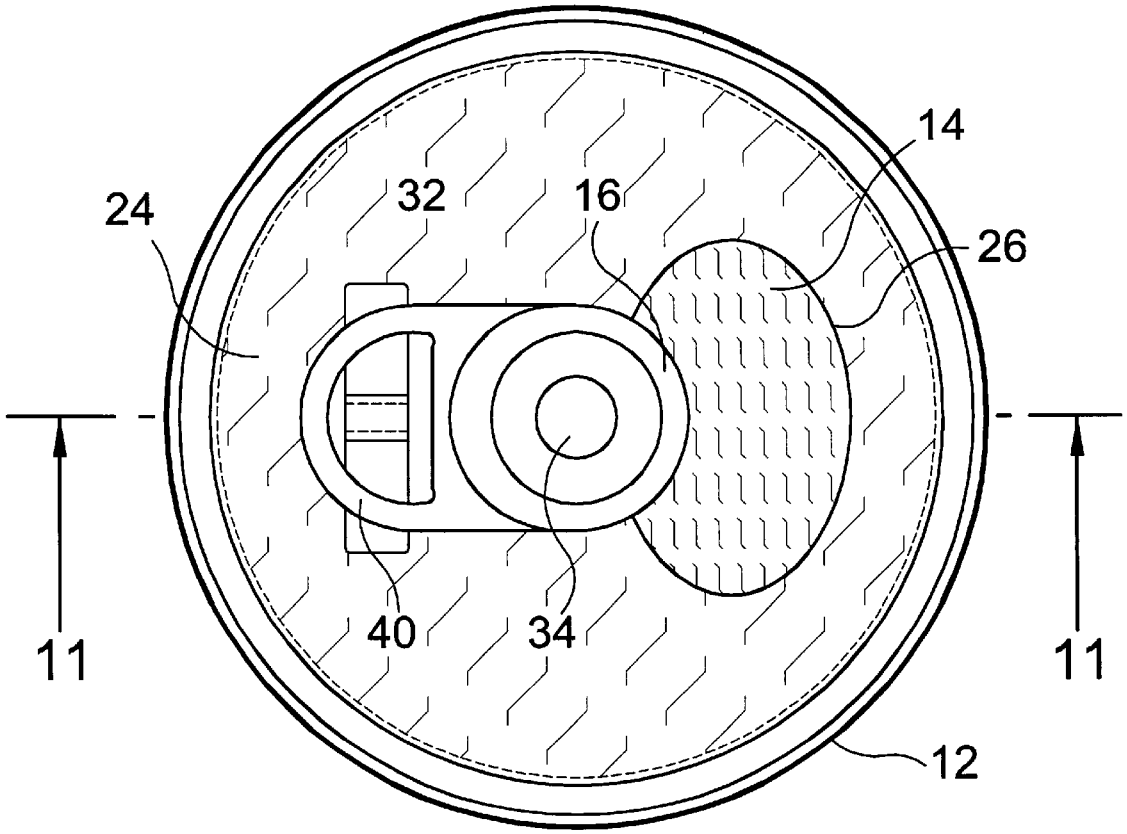
FIG. 10 is a top view of the present invention in the closed position.

FIG. 10 is a top view of the present invention 10 in the closed position. The rotatable sealing plate 24 is positioned between the penetrating tab 16 and the fixed top plate 14 and are rotatably fastened together by the pivoting fastening element 34. There is a recess 26 in the sealing plate 24 of the same shape and size of the etched section 18 defining the access tab 30. When the penetrating tab. 16 is lifted though the sealing plate recess 24 it partially separates the access tab 30 from the fixed top plate 14.

Figure 11:
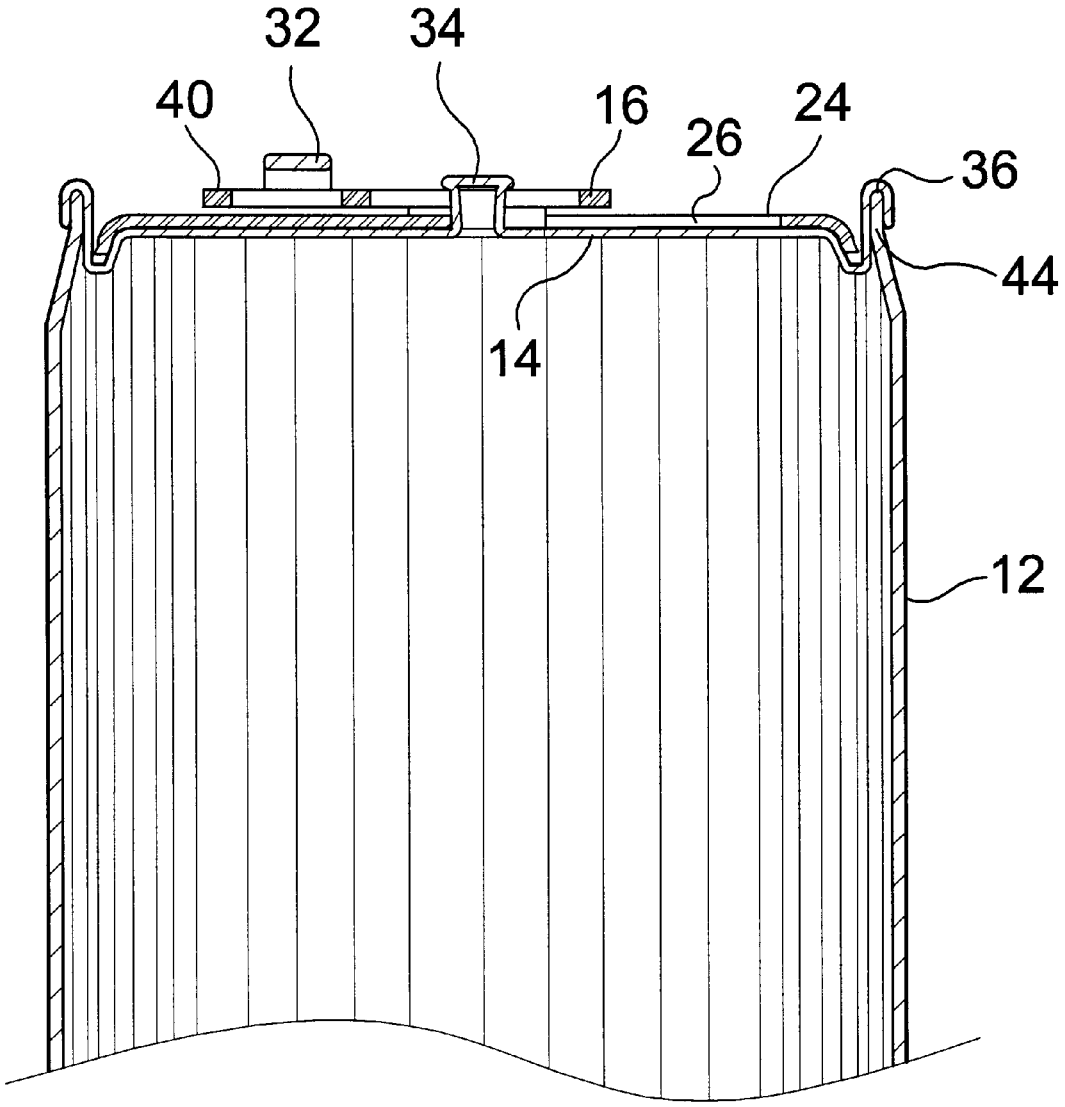
FIG. 11 is a cross sectional view in reference to FIG. 9 of the present invention.

FIG. 11 is a cross sectional side view of the present invention 10 taken from FIG. 10 as indicated. Like the conventional container 20, the present invention 10 provides an interlocking seal between the base container 12 and fixed top plate 14. The fixed top plate 14 is sealed around a flange 44 on the outer rim of the base container 16. In addition, the fixed top plate 14 includes a channel 36 around the outer rim to guide the flange 44 in the rotating closure. The sealing plate 24 is positioned between the penetrating tab 16 and the fixed top plate 14 and is secured by the pivoting fastening element 34. In this state, the contents of the container are preserved and protected from contamination.

Figure 12:
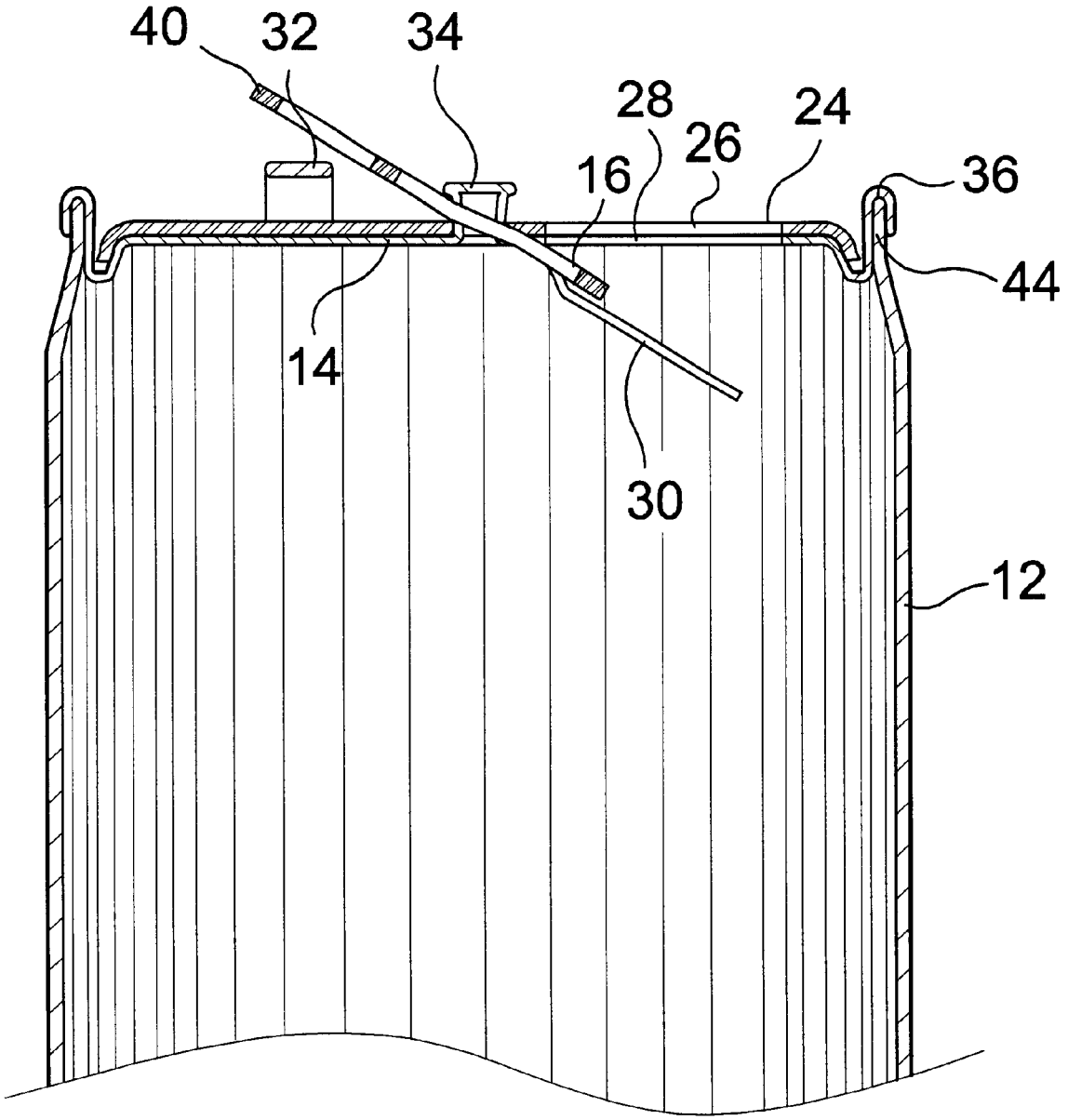
FIG. 12 is a cross sectional view in reference to FIG. 10 of the existing art in the open position.

FIG. 12 is a cross sectional side view of the present invention 10 in the open position. Like the conventional container 20, the invention assembly 10 allows access to the contents of the base container 12 by lifting upward on the first end 40 of the lever mechanism 38 so that the second end 42 thereof with it's penetrating tab 16 applies pressure against the sealed access tab 30. Using the finger handle 32, rotate sealing plate 24 and align the opening in the sealing plate over the etched section of the fixed top plate 14. Upon lifting, the tab will pivot at the pivoting fastening element 34. This will partially separate the access tab from the fixed top plate 14 as defined by the etched section 18 thereof thereby providing access to the contents contained therein. Once the access recess has been established the user rotates the sealing plate 24 into the misaligned position to prevent contaminates from entering the base container 12.

Figure 13:
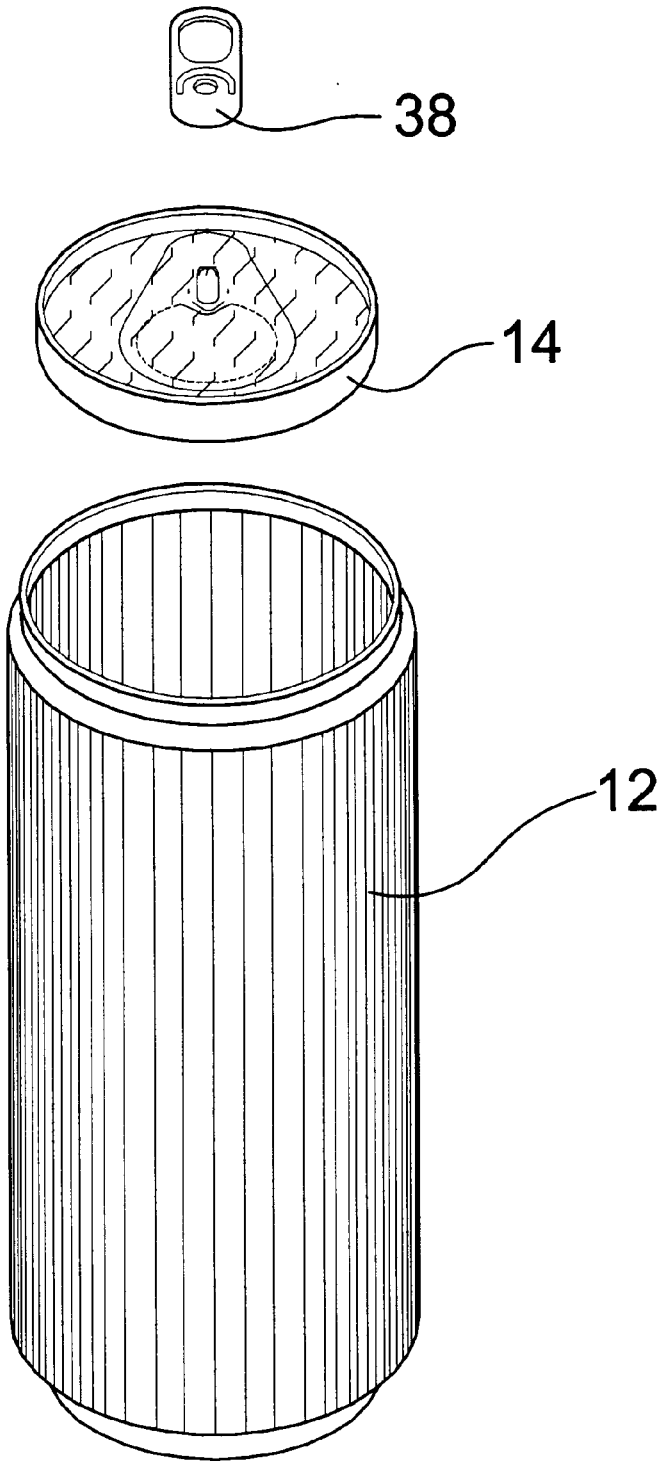
FIG. 13 (PRIOR ART)
FIG. 13 is an exploded isometric view of the existing art.

FIG. 13 is an exploded perspective view of a typical beverage container 20 showing the base container, the fixed top plate 14 and the lever mechanism 38.

Figure 14:
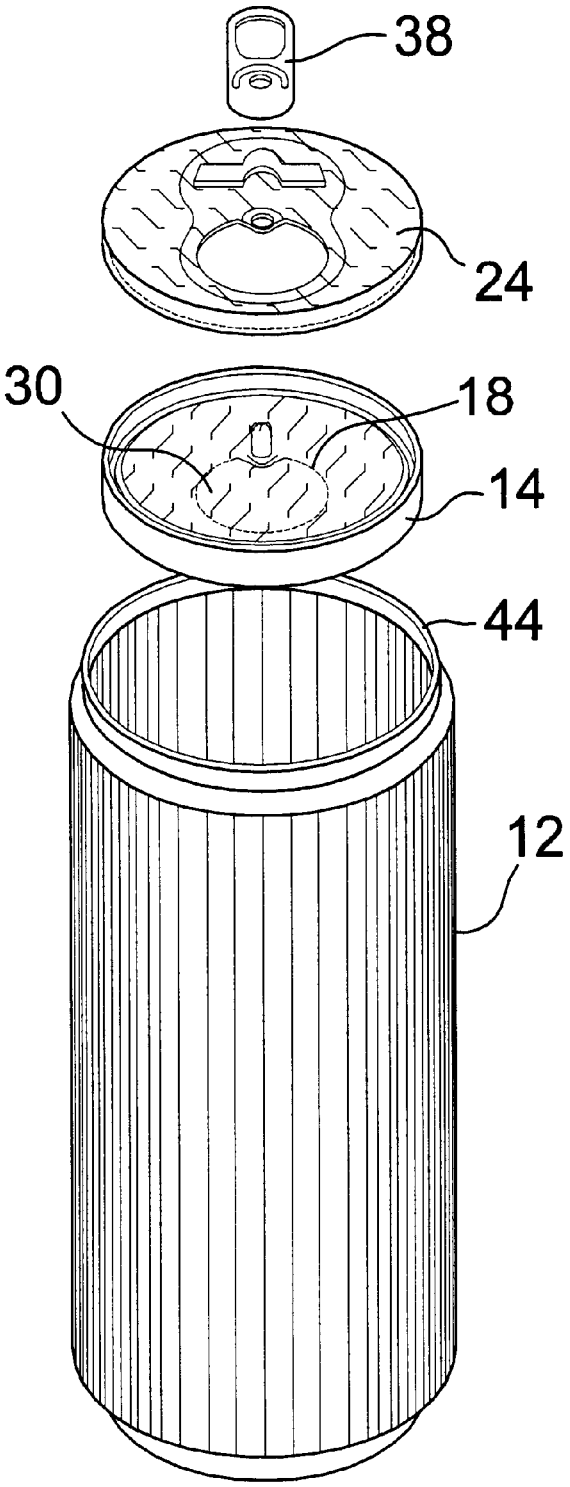
FIG. 14 is an exploded isometric view of the present invention.

FIG. 14 is an exploded perspective view of the present invention showing the base container 12 with flange 44, the fixed top plate 14 with etched access tab 30 intact and the rotative sealing plate 24 with lever mechanism 38.

It will be understood that each of the elements described above, or two or more together may also find a useful application in other types of methods differing from the type described above.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. A rotative closure for beverage containers comprising:

a) a substantially cylindrical base container having a closed bottom and an open top;

b) a fixed top plate member having a channel that when placed over the open top of said base container and attached thereto forms a hermetically sealed chamber therein;

c) an etched access tab manufactured in said fixed top plate member that partially separates from said fixed top plate member when pressure is applied thereto;

d) a lever mechanism having a first end to which force is applied upward and a second end forming a penetration tab that applies pressure to said access tab when an upward force is applied to said first end;

e) a rotatable sealing plate with a recess conforming substantially to said fixed top plate and its respective recess and residing thereupon;

f) a pivoting fastening element fastening said lever mechanism and said rotatable sealing plate to said fixed top plate in a manner to allow said rotatable sealing plate to rotate with respect to said fixed top plate; and g) means on said rotatable sealing plate for engaging said lever mechanism so that said lever mechanism rotates with said rotatable sealing plate comprising an inverted U-shaped finger handle with flat ends attached to said rotatable sealing plate and a curved upper section extending through an opening in the first end of said lever mechanism.

2. A closure for a can circular in cross section comprising;

a) a fixed disc and a rotatable disc, said rotatable disc being mounted on top of said fixed disc and attached to said fixed disc by a fastening element located at the center of both said discs allowing said rotatable disc to rotate with respect to said fixed disc;

b) a lift tab mounted on said fastening element to allow for rotation of said lift tab with said rotatable disc, said lift tab having an opening at a fulcrum to accommodate said fastening element;

c) said fixed disc having an etched section adapted to be separated from said fixed disc when said lift tab is lifted to apply pressure around said fulcrum on said etched section;

d) a finger handle mounted on said rotatable disc extending through said lift tab for facilitating rotation of said rotatable disc and said lift tab, said finger handle comprising an inverted U-shaped member with flat ends attached to said rotatable sealing plate with a curved upper section extending through said lift tab; and e) said rotatable disc having an opening allowing said rotatable disc to be rotated to a position to align the openings in said fixed and rotatable discs to allow access to liquid within said container and rotated to another position where said openings are not aligned and the contents of said can are protected against contamination and spilling.

* * * * *